US007239309B2

(12) United States Patent
Smith et al.

(10) Patent No.: US 7,239,309 B2
(45) Date of Patent: Jul. 3, 2007

(54) DISPLAY DRIVERS

(75) Inventors: Euan C. Smith, Cambridge (GB); Paul R. Routley, Cambridge (GB)

(73) Assignee: Cambridge Display Technology Limited, Cambridge (GB)

( * ) Notice: Subject to any disclaimer, the term of this patent is extended or adjusted under 35 U.S.C. 154(b) by 430 days.

(21) Appl. No.: 10/493,127

(22) PCT Filed: Oct. 23, 2002

(86) PCT No.: PCT/GB02/04773

§ 371 (c)(1),
(2), (4) Date: Aug. 30, 2004

(87) PCT Pub. No.: WO03/038790

PCT Pub. Date: May 8, 2003

(65) Prior Publication Data

US 2005/0007320 A1 Jan. 13, 2005

(30) Foreign Application Priority Data

Oct. 31, 2001 (GB) ..... 0126120.5

(51) Int. Cl.
*G09G 3/20* (2006.01)

(52) U.S. Cl. ..... 345/207; 345/98; 345/204; 345/205; 345/690; 315/156; 315/169.3; 365/215

(58) Field of Classification Search ..... 345/5, 345/98, 204, 205, 206, 207, 690; 315/156, 315/169.3; 365/215
See application file for complete search history.

(56) References Cited

U.S. PATENT DOCUMENTS 4,539,507 A 9/1985 VanSlyke et al. ..... 313/504

(Continued)

FOREIGN PATENT DOCUMENTS

EP 717 446 A2 6/1996

(Continued)

OTHER PUBLICATIONS

Komatsu, Motoyoshi, Data replacement system of measured devices; Pub. Date Jul. 2, 1982; Pub. No. JP357106817A.*

(Continued)

*Primary Examiner*—Bipin Shalwala
*Assistant Examiner*—Vincent E. Kovalick
(74) *Attorney, Agent, or Firm*—Marshall, Gerstein & Borun LLP

(57) ABSTRACT

Display driver circuitry for electro-optic displays, in particular active matrix displays using organic light emitting diodes. The circuitry includes a driver to drive an electro-optic display element in accordance with a drive voltage, a photosensitive device optically coupled to the electro-optic display element to pass a current dependent upon illumination reaching photosensitive device, a control circuit having a control line coupled to the driver to control the brightness of the electro-optic display element and having a current sense input coupled to the photosensitive device, a current set line for coupling to a reference current generator, and a display element select line to, when active, cause the control circuit to drive the electro-optic display element in accordance with the current set by the reference current generator. The circuit provides improved control of an electro-display element such as an organic LED pixel.

22 Claims, 5 Drawing Sheets

U.S. PATENT DOCUMENTS

| | | | | |
|---|---|---|---|---|
| 5,336,978 | A * | 8/1994 | Alessio | 315/169.3 |
| 5,410,502 | A * | 4/1995 | Bird | 365/108 |
| 5,483,263 | A * | 1/1996 | Bird et al. | 345/207 |
| 2001/0038081 | A1* | 11/2001 | De Wulf | 250/551 |
| 2002/0021094 | A1* | 2/2002 | De Wulf | 315/1 |
| 2002/0047550 | A1 | 4/2002 | Tanada | 315/155 |
| 2005/0057581 | A1* | 3/2005 | Horiuchi et al. | 345/690 |

FOREIGN PATENT DOCUMENTS

| | | | |
|---|---|---|---|
| EP | 717 446 | A3 | 6/1996 |
| EP | 880 303 | A1 | 11/1998 |
| EP | 923 067 | A1 | 6/1999 |
| EP | 1 096 466 | A1 | 5/2001 |
| EP | 1 102 234 | A2 | 5/2001 |
| GB | 1210772 | | 10/1970 |
| GB | 2360870 | A | 10/2001 |
| JP | 5-35207 | | 2/1993 |
| JP | 2002-169511 | | 6/2002 |
| WO | WO 90/13148 | | 11/1990 |
| WO | WO 99/42983 | | 8/1999 |
| WO | WO 99/48160 | | 9/1999 |
| WO | WO 99/54936 | | 10/1999 |
| WO | WO 01/15232 | A1 | 3/2001 |
| WO | WO 01/20591 | A1 | 3/2001 |

OTHER PUBLICATIONS

International Search Report in PCT/GB02/04773 dated Apr. 24, 2003.

International Preliminary Examination Report in PCT/GB02/04773 dated Sep. 3, 2003.

Search Report in GB 0126120.5 dated Oct. 21, 2003.

* cited by examiner

250

DISPLAY DRIVERS

This is the U.S. national phase of International Application No. PCT/GB02/04773 filed Oct. 23, 2002, the entire disclosure of which is incorporated herein by reference.

BACKGROUND OF THE INVENTION

1. Field of the Invention

This invention generally relates to display drivers for electro-optic displays, and in particular relates to circuitry for driving active matrix organic light emitting diode displays.

2. Description of Related Technology

Organic light emitting diodes (OLEDs) comprise a-particularly advantageous form of electro-optic display. They are bright, colourful, fast-switching, provide a wide viewing angle and are easy and cheap to fabricate on a variety of substrates. Organic LEDs may be fabricated using either polymers or small molecules in a range of colours (or in multi-coloured displays), depending upon the materials used. Examples of polymer-based organic LEDs are described in WO 90/13148, WO 95/06400 and WO 99/48160; examples of so called small molecule based devices are described in U.S. Pat. No. 4,539,507.

A basic structure 100 of a typical organic LED is shown in FIG. 1*a*. A glass or plastic substrate 102 supports a transparent anode layer 104 comprising, for example, indium tin oxide (ITO) on which is deposited a hole transport layer 106, an electroluminescent layer 108, and a cathode 110. The electro luminescence layer 108 may comprise, for example, a PPV (poly(p-phenylenevinylene)) and the hole transport layer 106, which helps match the hole energy levels of the anode layer 104 and electroluminescent layer 108, may comprise, for example, PEDOT:PSS (polystyrene-sulphonate-doped polyethylene-dioxythiophene). Cathode layer 110 typically comprises a low work function metal such as calcium and may include an additional layer immediately adjacent electroluminescent layer 108, such as a layer of aluminium, for improved electron energy level matching. Contact wires 114 and 116 to the anode the cathode respectively provide a connection to a power source 118. The same basic structure may also be employed for small molecule devices.

In the example shown in FIG. 1*a* light 120 is emitted through transparent anode 104 and substrate 102 and such devices are referred to as "bottom emitters". Devices which emit through the cathode may also be constructed, for example by keeping the thickness of cathode layer 110 less than around 50–100 nm so that the cathode is substantially transparent.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. It will be appreciated that with such an arrangement it is desirable to have a memory element associated with each pixel so that the data written to a pixel is retained whilst other pixels are addressed. Generally this is achieved by a storage capacitor which stores a voltage set on a gate of a driver transistor. Such devices are referred to as active matrix displays and examples of polymer and small-molecule active matrix display drivers can be found in WO 99/42983 and EP 0,717,446A respectively.

FIG. 1*b* shows such a typical OLED driver circuit 150. A circuit 150 is provided for each pixel of the display and ground 152, $V_{ss}$ 154, row select 164 and column data 166 busbars are provided interconnecting the pixels. Thus each pixel has a power and ground connection and each row of pixels has a common row select line 164 and each column of pixels has a common data line 166.

Each pixel has an organic LED 156 connected in series with a driver transistor 158 between ground and power lines 152 and 154. A gate connection 159 of driver transistor 158 is coupled to a storage capacitor 160 and a control transistor 162 couples gate 159 to column data line 166 under control of row select line 164. Transistor 162 is a field effect transistor (FET) switch which connects column data line 166 to gate 159 and capacitor 160 when row select line 164 is activated. Thus when switch 162 is on a voltage on column data line 166 can be stored on a capacitor 160. This voltage is retained on the capacitor for at least the frame refresh period because of the relatively high impedances of the gate connection to driver transistor 158 and of switch transistor 162 in its "off" state.

Driver transistor 158 is typically an FET transistor and passes a (drain-source) current which is dependent upon the transistor's gate voltage less a threshold voltage. Thus the voltage at gate node 159 controls the current through OLED 156 and hence the brightness of the OLED.

The standard voltage-controlled circuit of FIG. 1*b* suffers from a number of drawbacks. The main problems arise because the brightness of OLED 156 is dependent upon the characteristics of the OLED and of the transistor 158 which is driving it. In general, these vary across the area of a display and with time, temperature, and age. This makes it difficult to predict in practice how bright a pixel will appear when driven by a given voltage on column data line 166. In a colour display the accuracy of colour representations may also be affected.

Two circuits which partially address these problems are shown in FIGS. 2*a* and 2*b*. FIG. 2*a* shows a current-controlled pixel driver circuit 200 in which the current through an OLED 216 is set by setting a drain source current for OLED driver transistor 212 using a reference current sink 224 and memorising the driver transistor gate voltage required for this drain-source current. Thus the brightness of OLED 216 is determined by the current, $I_{col}$, flowing into adjustable reference current sink 224, which is set as desired for the pixel being addressed. It will be appreciated that one current sink 224 is provided for each column data line 210 rather than for each pixel.

In more detail, power 202, 204, column data 210, and row select 206 lines are provided as described with reference to the voltage-controlled pixel driver of FIG. 1*b*. In addition an inverted row select line 208 is also provided, the inverted row select line being high when row select line 206 is low and vice versa. A driver transistor 212 has a storage capacitor 218 coupled to its gate connection to store a gate voltage for driving the transistor to pass a desired drain-source current. Drive transistor 212 and OLED 216 are connected in series between a power 202 and ground 204 lines and, in addition, a further switching transistor 214 is connected between drive transistor 212 and OLED 216, transistor 214 having a gate connection coupled to inverted row select line 208. Two further switching transistors 220,222 are controlled by non-inverted row select line 206.

In the embodiment of the current-controlled pixel driver circuit 200 illustrated in FIG. 2*a* all the transistors are PMOS, which is preferable because of their greater stability and better resistance to hot electron effects. However NMOS transistors could also be used. This is also true of circuits according to the invention which are described below.

In the circuit of FIG. 2*a* the source connections of the transistors are towards GND and for present generation OLED devices $V_{ss}$ is typically around −6 volts. When the row is active the row select line 206 is thus driven at −20 volts and inverted row select line 208 is driven at 0 volts.

When row select is active transistors 220 and 222 are turned on and transistor 214 is turned off. Once the circuit has reached a steady state reference current $I_{col}$, into current sink 224 flows through transistor 222 and transistor 212 (the gate of 212 presenting a high impedance). Thus the drain-source current of transistor 212 is substantially equal to the reference current set by current sink 224 and the gate voltage required for this drain-source current is stored on capacitor 218. Then, when row select becomes inactive, transistors 220 and 222 are turned off and transistor 214 is turned on so that this same current now flows through transistor 212, transistor 214, and OLED 216. Thus the current through OLED is controlled to be substantially the same as that set by reference current sink 224.

Before this steady state is reached the voltage on capacitor 218 will generally be different from the required voltage and thus transistor 212 will not pass a drain source current equal to the current, $I_{col}$, set by reference sink 224. When such a mismatch exists a current equal to the difference between the reference current and the drain-source current of transistor 212 flows onto or off capacitor 218 through transistor 220 to thereby change the gate voltage of transistor 212. The gate voltage changes until the drain-source current of transistor 212 equals the reference current set by sink 224, when the mismatch is eliminated and no current flows through transistor 220.

The circuit of FIG. 2*a* solves some of the problems associated with the voltage-controlled circuit of FIG. 1*b* as the current through OLED 216 can be set irrespective of variations in the characteristics of pixel driver transistor 212. However the circuit of FIG. 2*a* is still prone to variations in the characteristic of OLED 216 between pixels, between active matrix display devices, and over time. A particular problem with OLEDs is a tendency for their light output to decrease over time, dependent upon the current with which they are driven (this may be related to the passage of electrons through the OLED). Such degradation is particularly apparent in a pixellated display where the relative brightness of nearby pixels can easily be compared. A further problem with the circuit of FIG. 2*a* arises because each of transistors 212, 214 and 222 must be sufficiently physically large to handle the current through OLED 216, which is equal to the $I_{col}$ reference current. Large transistors are generally undesirable and, depending upon the active matrix device structure, may also obscure or prevent the use of part of a pixel's area In an attempt to address these additional problems there have been a number of attempts to employ optical feedback to control the OLED current. These attempts are described in WO 01/20591, EP 0,923,067A, EP 1,096,466A, and JP 5-035,207 and all employ basically the same technique. FIG. 2*b*, which is taken from WO 01/20591, illustrates the technique, which is to connect a photodiode across the storage capacitor.

FIG. 2*b* shows a voltage-controlled pixel driver circuit 250 with optical feedback 252. The main components of the driver circuit 250 of FIG. 2*b* correspond to those of circuit 150 of FIG. 1*b*, that is, an OLED 254 in series with a driver transistor 256 having a storage capacitor 258 coupled to its gate connection. A switch transistor 260 is controlled by a row conductor 262 and, when switched on, allows a voltage on capacitor 258 to be set by applying a voltage signal to column conductor 264. Additionally, however, a photodiode 266 is connected across storage capacitor 258 so that it is reverse biased. Thus photo diode 266 is essentially non conducting in the dark and exhibits a small reverse conductance depending upon the degree of illumination. The physical structure of the pixel is arranged so that OLED 254 illuminates photodiode 266, thus providing an optical feedback path 252.

The photocurrent through photodiode 266 is approximately linearly proportional to the instantaneous light output level from OLED 254. Thus the charge stored on capacitor 258, and hence the voltage across the capacitor and the brightness of OLED 254, decays approximately exponentially over time. The integrated light output from OLED 254, that is the total number of photons emitted and hence the perceived brightness of the OLED pixel, is thus approximately determined by the initial voltage stored on capacitor 258.

The circuit of FIG. 2*b* solves the aforementioned problems associated with the linearity and variability of the driver transistor 256 and OLED 254 but exhibits some significant drawbacks in its practical implementation. The main drawback is that every pixel of the display needs refreshing every frame as storage capacitor 258 is discharged over no more than this period. Related to this, the circuit of FIG. 2*b* has a limited ability to compensate for ageing effects, again because the light pulse emitted from OLED 254 cannot extend beyond the frame period. Similarly, because the OLED is pulsed on and off it must be operated at an increased voltage for a given light output, which tends to reduce the circuit efficiency. Finally, capacitor 258 often exhibits non-linearities so that the stored charge is not necessarily linearly proportional to the voltage applied on column conductor 264. This results in non-linearities in the voltage-brightness relationship for the pixel as photodiode 266 passes a photocurrent (and hence charge) which is dependent upon the level of illumination it receives.

SUMMARY

There is therefore a need for improved display driver circuitry for organic LEDs which addresses the above problems.

According to a first aspect of the present invention there is therefore provided display element driver circuitry for driving an element of an electro-optic display, the circuitry comprising, a driver to drive the electro-optic display element in accordance with a drive voltage, a photosensitive device optically coupled to the electro-optic display element to pass a current dependent upon illumination reaching the photosensitive device; and a control circuit having a control line coupled to the driver to control the brightness of the electro-optic display element and having a current sense input coupled to the photosensitive device, a current set line for coupling to a reference current generator and a display element select line to, when active, cause the control circuit to drive the electro-optic display element in accordance with a current set by the reference current generator.

Utilising optical feedback in this way allows the electro-optic display element light output to be directly controlled by a reference current flowing into a column line, and thus overcomes the problems associated with the prior art optical feedback technique in which the display element light output is effectively pulsed. Furthermore the linearity of the circuit's response is essentially controlled by the linearity of the photosensitive device and devices, which have good linearity, such as photo diodes, are relatively easy to fabricate. As will be explained below, the circuit also needs only one large transistor, for the driver, rather than the three large transistors required by a current-controlled driver circuit in which the drive current rather than the light output is servoed.

Preferably the display driver circuitry includes a storage element, such as a capacitor or digital capacitor, coupled to the control line. In this way, when the element select line is inactive a drive voltage set by the reference current generator may be memorised.

The storage element may comprise an internal capacitance of the driver and, where the driver comprises a FET (Field Effect Transistor) the storage element may simply comprise the FET gate capacitance. The FET may be fabricated for increased gate capacitance to effectively integrate the storage element with the driver transistor. In use an error current flows into or out of the control line to deposit or remove charge from the capacitor, to change the voltage across capacitor and hence the drive voltage.

In a preferred embodiment a common-gate (FET) transistor or common-base (bipolar) transistor is coupled between the photosensitive device and the current sense input to reduce the voltage across the photosensitive device. Reducing the voltage across the device reduces the leakage current through the device, which is advantageous because the photocurrent through the device is generally relatively small, particularly at low display element brightness levels. This common-gate or common-base transistor may advantageously be biased using a second transistor with a matched $V_T$ (gate-source threshold voltage) or a matched $V_{be}$ (base-emitter voltage). Current can then be passed through the second transistor to set a gate (or base) voltage for the second transistor which can then be applied to the common-gate (or common-base) transistor to set an appropriate bias point.

In a refinement of this preferred embodiment the reference current flowing in the column line may be diverted through the second transistor in an initial bias-set cycle before the optical feedback path is utilized. This may be achieved by providing a switch to divert the current through the second transistor and, preferably, a second switch and a further storage element to hold a bias condition set in this way. The switches are preferably controlled by a compensate line which is activated to set the bias for the common-gate (or common-base) transistor before the display element select line is activated.

In a preferred embodiment display element driver circuitry of the above-described type is provided for each pixel in an active matrix display. In such an arrangement a display, row address line is coupled to the display element select lines of pixels in a corresponding row, and a display element column select line is coupled to the current set lines of pixels in a corresponding column, or vice-versa. A programmable reference current generator is then preferably provided for each column address line so that the brightness of pixels in a selected row may be programmed.

In a corresponding aspect the invention also provides a method of controlling the brightness of electro-optic display elements in an active matrix display, the method comprising, providing a photosensitive device for each element, the photosensitive device passing a photocurrent dependent upon the illumination of the device, sensing the brightness of each element by sensing the photocurrent passed by the photosensitive device for the element; and controlling the brightness of each element so that the sensed photocurrent is determined by and preferably substantially matches a reference current.

Preferably the active matrix display includes a voltage-controlled driver for each display element, each driver having a storage capacitor to store a display element drive voltage. The method may then further comprise compensating for a difference between the reference current and the photocurrent by charging or discharging the storage capacitor.

As described above the method preferably further includes operating the photosensitive device under reduced bias conditions by dropping at least a portion of a bias voltage for the device across a transistor. In refinement of this method a bias cycle is provided prior to the brightness sensing and controlling, to set a bias for the photosensitive device using the reference current.

Preferably the electro-optic display element comprises an organic light emitting diode.

BRIEF DESCRIPTION OF THE DRAWINGS

These and other aspects of the invention will now be further described by way of example only, with reference to the accompanying figures in which.

DETAILED DESCRIPTION

Figure 1A:
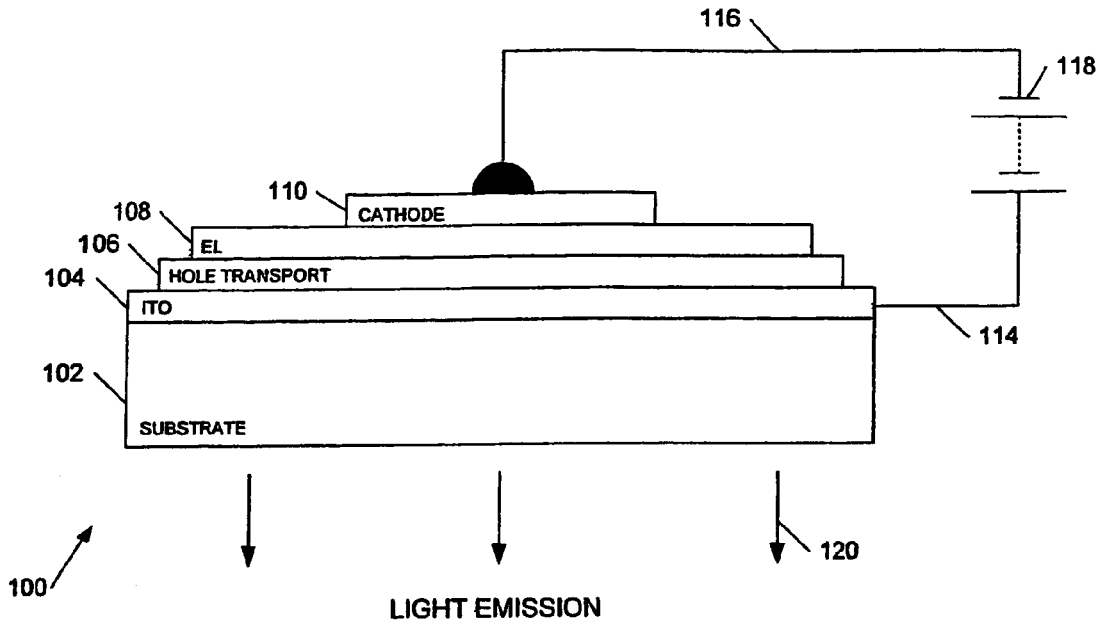
Figure 1a (PRIOR ART)
FIGS. 1*a* and 1*b* show, respectively, a basic organic LED structure, and a typical voltage-controlled OLED driver circuit.
Figure 1B:
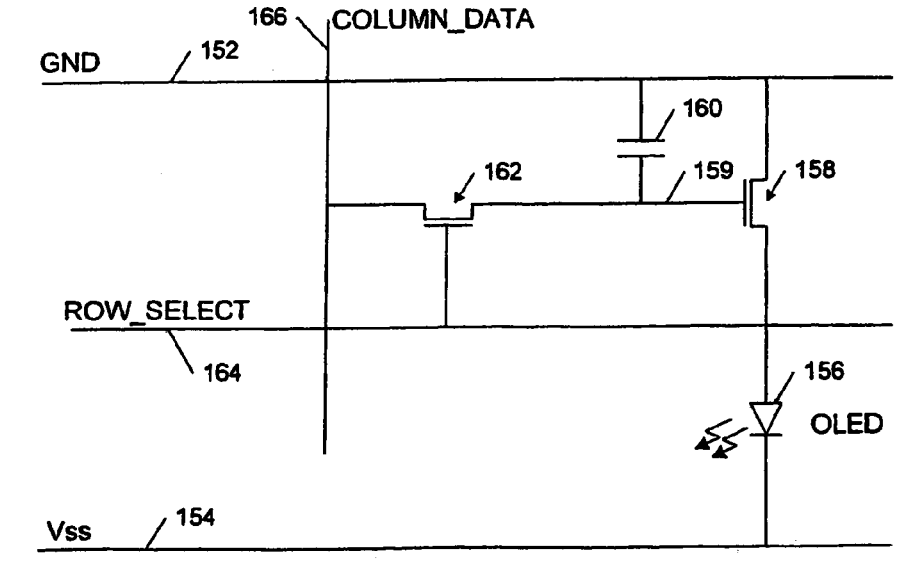
Figure 1b (PRIOR ART)
Figure 2A:
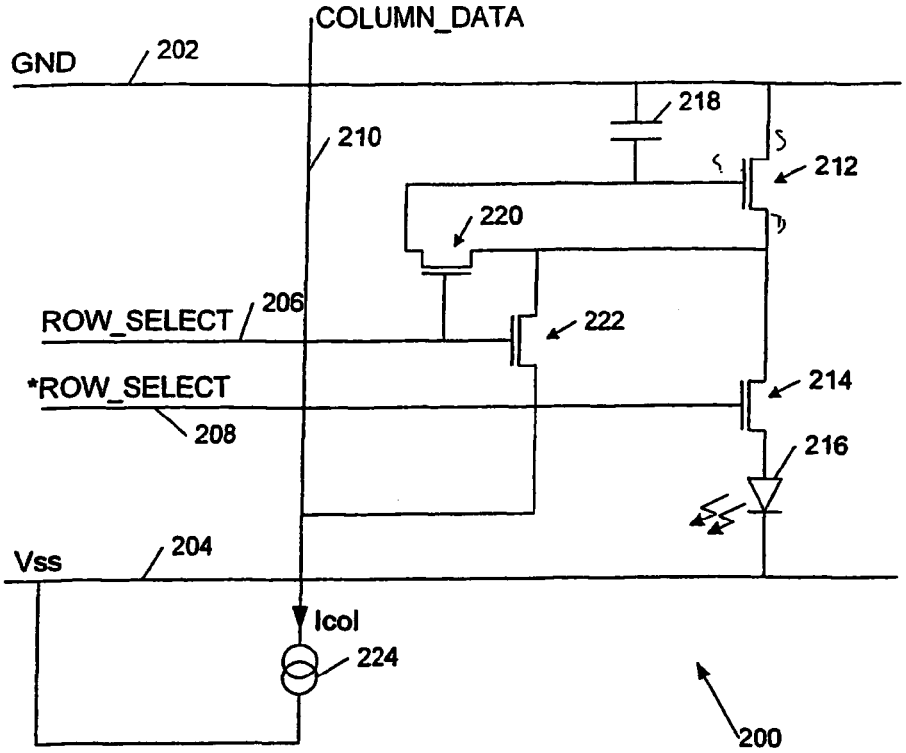
FIGS. 2*a* and 2*b* show, respectively, a current-controlled OLED driver circuit, and a voltage-controlled OLED driver circuit with optical feedback according to the prior art.
Figure 2B:
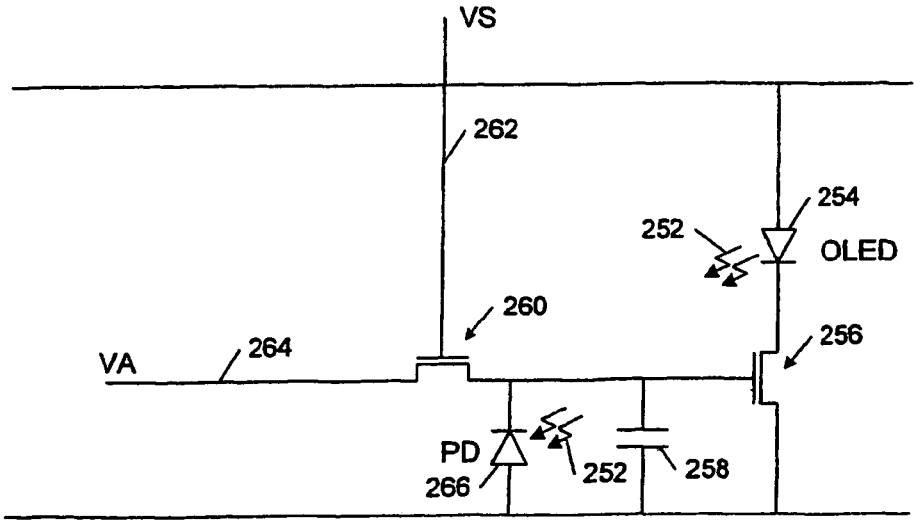
Figure 2b (PRIOR ART)
Figure 3A:
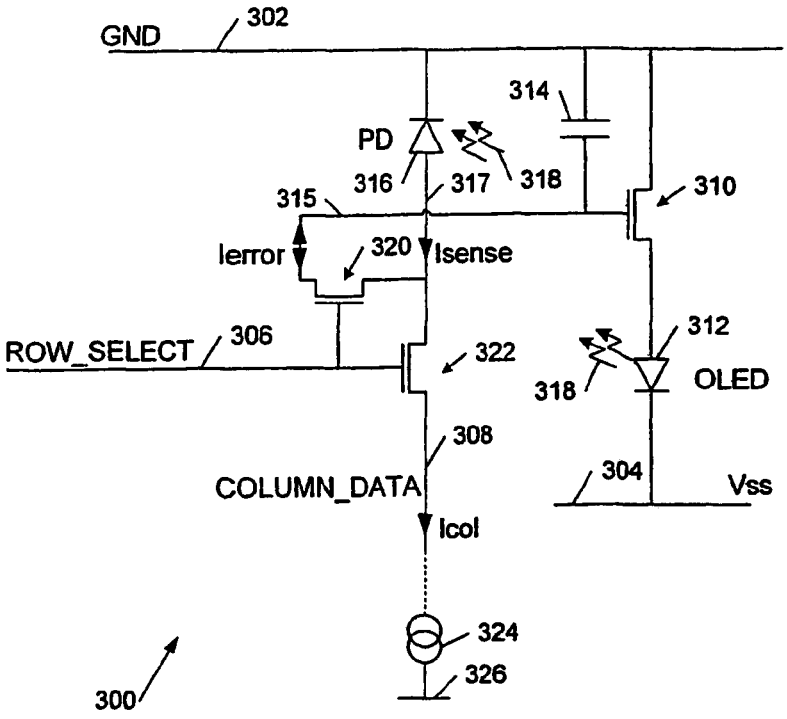
FIGS. 3*a* to 3*c* show, respectively, a current-controlled OLED driver circuit with optical feedback, a first alternative switching arrangement, and a second alternative switching arrangement.

Referring first to FIG. 3*a*, this shows a current-controlled organic LED driver circuit 300 with optical feedback according to an embodiment of the present invention. In an active matrix display typically each pixel is provided with such a driver circuit and further circuitry (not shown) is provided to address the pixels row-by-row, to set each row at the desired brightness. To power and control the driver circuitry and OLED display element such an active matrix display is provided with a grid of electrodes including, as shown, a ground (GND) line 302, a power or $V_{ss}$ line 304, a row select line 306 and a column data line 308. Each column data line is connected to a programmable constant current reference source (or sink) 324. This is not part of the driver circuitry provided for each pixel but instead comprises part of the circuitry provided for each column. Reference current generator 324 is programmable so that it can be adjusted to a desired level to set a pixel brightness, as described in more detail below.

The driver circuit 300 comprises a driver transistor 310 connected in series with an organic LED display element 312 between the GND 302 and $V_{ss}$ 304 lines. A storage capacitor 314, which may be integrated with the gate of transistor 310, stores a charge corresponding to a memorised gate voltage to control the drive current through OLED element 312. Control circuitry for the driver comprises two switching transistors 320, 322 with a common gate connection coupled to row select line 306. When row select line 306 is active these two switch transistors are on, that is the switches are "closed", and there is a relatively low impedance connection between lines 315, 317 and 308. When row select line 306 is inactive transistors 320 and 322 are switched off, capacitor 314 and the gate of transistor 310 are effectively isolated, and any voltage set on capacitor 314 is memorised.

In the circuit of FIG. 3*a*, and in the circuits of FIG. 3*b*, 3*c*, 4 and 5 described later, the transistors are all PMOS.

A photodiode 316 is coupled between GND line 302 and line 317 so that it is reverse biassed. The photodiode is physically arranged with respect to the OLED display element 312 such that an optical feedback path 318 exists between OLED 312 and photodiode 316. In other words, OLED 312 illuminates photodiode 316 and this allows an illumination-dependent current to flow in a reverse direction through photodiode 316, that is from GND line 302 towards $V_{ss}$. As the skilled person will understand, broadly speaking each photon generates an electron within photodiode 316 which can contribute to a photocurrent.

Column data line 308 is coupled, at the end of a column, to programmable reference current generator 324. This attempts to cause a reference current, which will be referred to as $I_{col}$, to flow to off-pixel $V_{ss}$ connection 326. Line 317 may be referred to as a current sense line, passing a current $I_{sense}$ and line 315 may be referred to as a control line, passing a current $I_{error}$ to set a voltage on capacitor 314 to control OLED 312. When row select line 306 is active and transistors 320 and 322 are $I_{col}=I_{sense}+I_{error}$ and thus a current $I_{error}$ flows either onto or off capacitor 314 until OLED 312 illuminates photodiode 316 such that $I_{sense}=I_{col}$. At this point row select line 306 can be deactivated, and the voltage required for this level of brightness is memorised by capacitor 314.

The time required for the voltage on capacitor 314 to stabilise depends upon a number of factors, which may be varied in accordance with the desired device characteristics, and may be a few microseconds. Broadly speaking a typical OLED drive current is of the order of 1 μA whilst a typical photocurrent is around 0.1% of this, or of the order of 1 nA (in part dependent upon the photodiode area). It can therefore be seen that the power handling requirements of transistors 320 and 322 are negligible compared with that of the drive transistor 310, which must be relatively large. To speed up the settling time of the circuit it is preferable to use a relatively small value for capacitor 314 and a relatively large area photodiode to increase the photocurrent. This also helps reduce the risk of noise and stability at very low brightness levels associated with stray or parasitic capacitance on column data line 308.

Figure 3B:
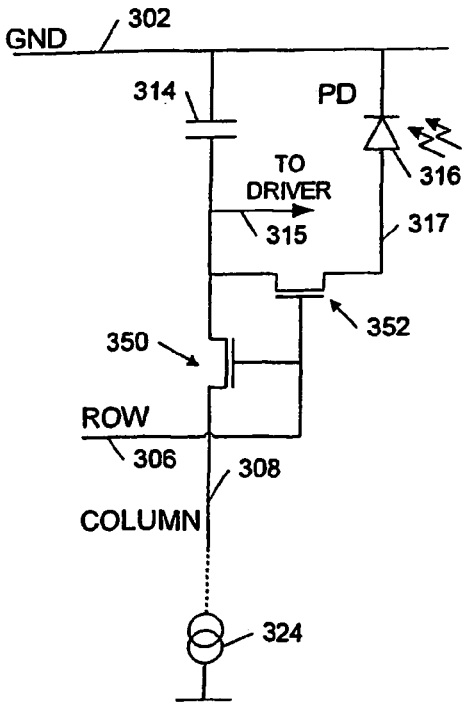
Figure 3C:
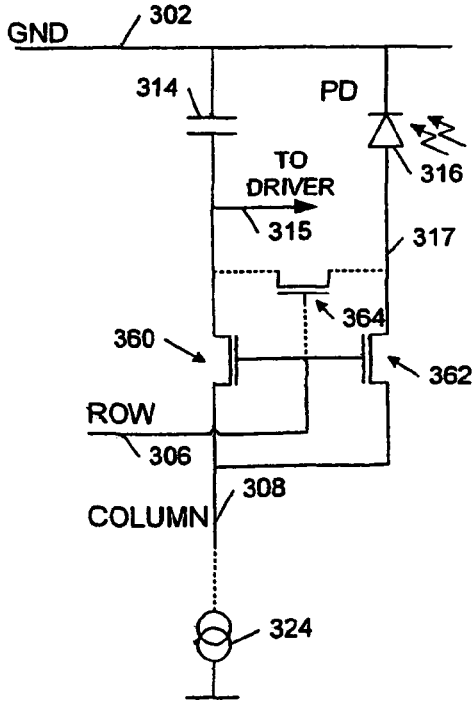

FIGS. 3*b* and 3*c* show a portion of the circuit of FIG. 3*a* illustrating different possible configurations for switching transistors corresponding to switching transistors 320 and 322 of FIG. 3*a* The purpose of transistors 320 and 322 is to couple lines 315, 317 and 308 when row select line 306 is active and it will be appreciated that there are three different ways of connecting three nodes using two controllable switches. In FIG. 3*b* a first switching transistor 350 is connected between lines 308 and 315 and a second switching transistor 352 is connected between lines 315 and 317. Both transistors 350 and 352 are controlled by row select line 306. In FIG. 3*c* a first switching transistor 360 is connected between lines 308 and 315 and a second switching transistor 362 is connected between lines 308 and 317. Optionally a third switching transistor 364 may be connected between lines 315 and 317. The two (or three) switching transistors are all controlled by row select line 306.

Figure 4:
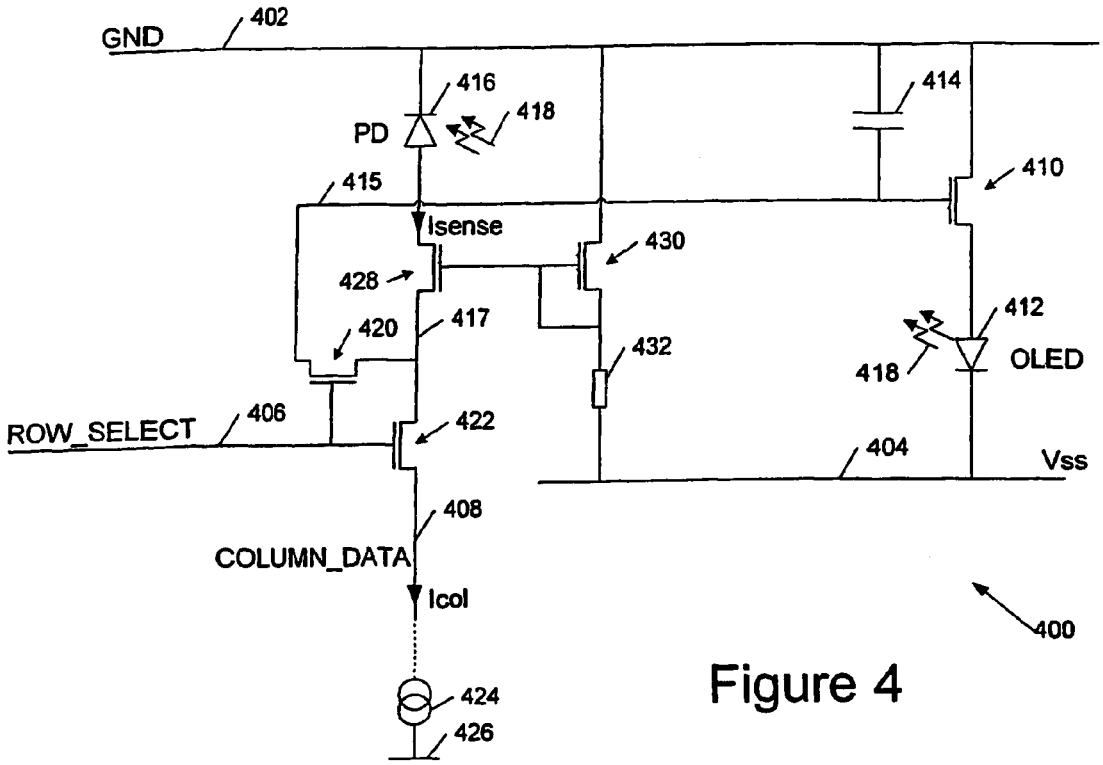
FIG. 4 shows a current-controlled OLED driver circuit with optical feedback and reduced photodiode bias.

One drawback of the basic circuit of FIG. 3*a* is the leakage current through photodiode 316 which flows when this photodiode is reverse biased. The leakage current is voltage dependent and thus it can be reduced by reducing the bias voltage across photodiode 316. FIG. 4 shows an improved circuit 400 in which this is achieved. The circuit of FIG. 4 is a modification of the circuit of FIG. 3*a* and elements indicated by reference numerals 402 to 426 correspond to elements 302 to 326 of the circuit of FIG. 3*a*.

The additional components in driver circuit 400 of FIG. 4, as compared with driver circuit 300 of FIG. 3*a*, are transistors 428 and 430 and resistor 432. In driver circuit 300 of FIG. 3*a* when row select 306 is active the voltage across photodiode 316 is approximately equal to the gate voltage of driver transistor 310 on line 315, because switching transistor 320 is on (closed). As the skilled person will be aware, the gate voltage on a FET is equal to a threshold voltage $V_T$, plus an additional voltage, which will be referred to as $V_{control}$, required to set the desired drain-source current, $I_{ds}$. In FIG. 4 transistor 428 is used to drop at least this threshold voltage, thus leaving only a voltage approximately equal to $V_{control}$ across photodiode 416. This is done by employing transistor 428 in a common-gate configuration, with a gate bias voltage set by transistor 430 and resistor 432.

In the embodiment drawn in FIG. 4 transistors 428 and 430 are both PMOS devices and so have their source connection towards GND. Transistor 430 has its drain and gate coupled together and thus operates as a (non-linear) resistor. Transistor 430 is connected in series with resistor 432 between GND line 402 and $V_{ss}$ line 404, and a drain-source current of transistor 430 is determined by the transistor characteristics and the value of resistor 432. The gate voltage of transistor 430 necessary to provide this drain-source current is equal to the gate threshold voltage for transistor 430 plus an additional control voltage. The gate of transistor 428 is coupled to the gate of transistor 430 so that their gate voltages are substantially the same. Transistors 428 and 430 are preferably both matched so that they have substantially the same threshold voltage.

From the foregoing explanation it will be appreciated that transistor 428 drops an FET threshold voltage plus a small additional control voltage dependent upon the drain-source current of transistor 430 set by resistor 432. When transistor 420 is on the voltage on line 417 is approximately equal to that on the gate of transistor 410. The threshold voltages of transistors 410 and 428 are approximately the same so that the bias voltage on photodiode 416 will therefore be approximately equal to the difference in $V_{control}$ on the gate of transistor 410 and on the gate of transistor 430. Preferably the drain-source current of transistor 430 is chosen to be similar to the drain-source current of transistor 410 when OLED 412 is dimly illuminated.

In operation the photocurrent $I_{sense}$ in line 417 is substantially unchanged as there is no alternative path for the current to take. Thus the servo mechanism of transistors 420 and 422 operates in the same way as the servo mechanism of transistors 320 and 322 in driver circuit 300. Transistor 428 is largely off, being turned on by an amount dependent upon the photocurrent through photodiode 416. As with driver circuit 300 capacitor 414 is charged such that this photocurrent, $I_{sense}$, equals $I_{col}$.

Some exemplary but not necessarily typical voltage values can be used to illustrate how the circuit works in practice. When OLED 412 is dark a voltage across photodiode 416, $V_{pd}$ equals −1 volt say, transistor 428 is substantially off, and the gate source voltage of transistor 428, $V_{GS}$ is $\cong V_T$. When OLED 412 is dimly lit, $V_{PD}$ equals −0.9 volt say, transistor 428 is slightly on and $V_{GS} \cong V_T + 0.1V$. When OLED 412 is bright $V_{PD}$ equals −0.5 volt say, transistor 428 is on, and $V_{GS} \cong V_T + 0.5v$. When photodiode 416 is extremely brightly illuminated the photodiode may operate as a photocell, in which case $V_{PD}$ equals +0.2 volt say, transistor 428 is full on, and $V_{GS} \cong V_T + 1.2v$.

Figure 5:
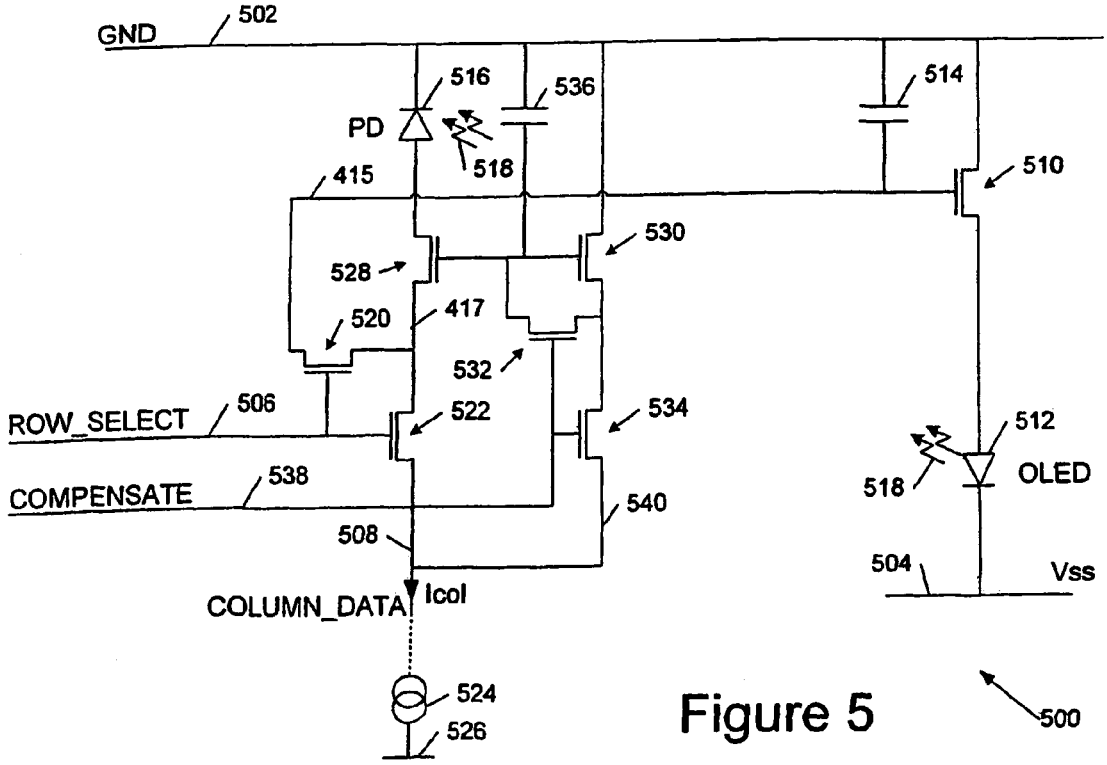
FIG. 5 shows a current-controlled OLED driver circuit with optical feedback and photodiode bias nulling means.

The circuit of FIG. 4 helps to reduce inaccuracies caused by leakage current through the photodiode by dropping approximately $V_T$ across transistor 428, but still leaves a residual photodiode bias voltage roughly corresponding to the (variable) control voltage required in addition to $V_T$. Thus the photo diode bias changes with the desired brightness of OLED 412—the brighter the OLED the less the reverse bias—in effect due to the finite transconductance of transistor 428. Employing a bipolar transistor rather than a FET for transistor 428 would increase the transconductance but reduce the accuracy with which $I_{col}$ determines $I_{sense}$. FIG. 5 shows a circuit in which the reference current $I_{col}$ can be directed through a bias set transistor to effectively null out this additional variation in photodiode bias voltage.

Referring to FIG. 5, this shows a driver circuit 500 including means to null a photodiode bias voltage. The driver circuit 500 of FIG. 5 is a modification of the driver circuit 400 of FIG. 4 and elements 502 to 530 correspond to elements 402 to 430 in FIG. 4. However resistor 432 coupling the drain of transistor 430 to $V_{ss}$ has been replaced by a transistor 534 coupling the drain of transistor 530 to column data line 508 via connection 540. The link between the drain and gate of transistor 430 has been broken and transistor 532 is now connected between the drain and gate of transistor 530. A bias voltage hold capacitor 536 has also been connected to the coupled gates of transistors 528 and 530. Transistors 532 and 534 operate as FET switches controlled by compensate line 538.

When compensate line 538 is active transistors 532 and 534 are switched on. The driver circuit 500 then operates in a similar manner to driver circuit 400, except that when row select line 506 is inactive the drain-source current of transistor 530 is substantially equal to the reference current, $I_{col}$, flowing into current sink 524, as transistor 522 is off. Thus when compensate line 538 is active and row select line 506 is inactive the gate voltage of transistor 530 is equal to the gate threshold voltage of transistor 530 plus the additional control voltage needed to provide a drain-source current in transistor 530 equal to $I_{col}$. Preferably transistor 530 is substantially matched to transistor 528 so that when the drain source current of transistor 528 is equal to $I_{col}$ and the gate source voltage of transistor 528 is the same as the gate source voltage of transistor 530 substantially all the photodiode bias voltage is dropped across transistor 528 leaving substantially zero bias voltage across photodiode 516. Capacitor 536 is connected to the gates of transistors 528 and 530 to store the bias voltage set in this way.

The driver circuit 500 of FIG. 5 is operated in two stages, a first, bias cycle stage in which a bias voltage is set for transistor 528 via transistor 530, and a second, pixel control stage in which the brightness of OLED 512 is controlled according to the reference current $I_{col}$. In the bias cycle stage compensate line 538 is active and row select line 506 is inactive; in the pixel control stage row select line 506 is active and compensate line 538 is inactive. Initially, compensate line 538 is activated and row select line 506 is deactivated for a predetermined interval, to allow capacitor 536 to be charged to the required bias voltage. Compensate line 538 is then deactivated and row select line 506 is activated and the main optical feedback servo loop is allowed to stabilise over a second predetermined interval. Both intervals are typically of the order of one to a few microseconds. Row select line 506 is then deactivated, capacitor 514 maintaining OLED 512 at its set brightness.

Figure 6A:
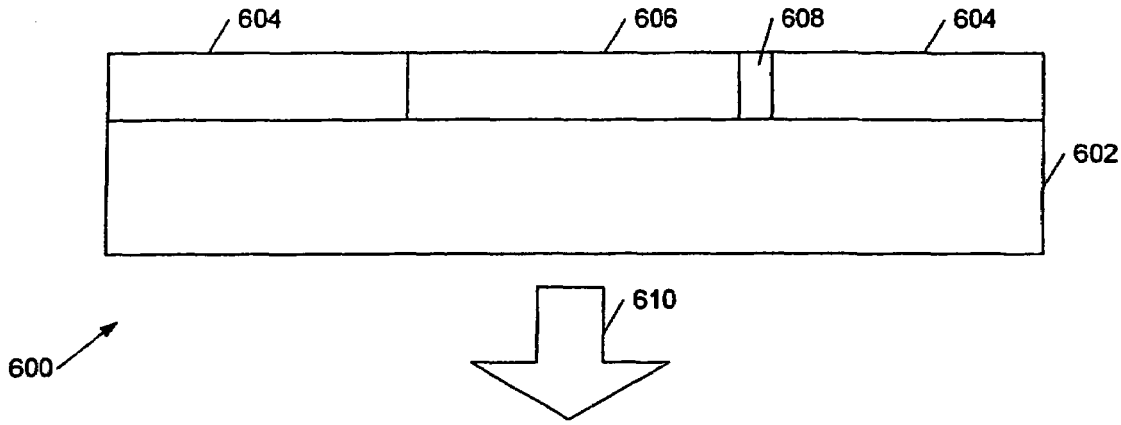
FIGS. 6*a* and 6*b* show vertical cross sections through device structures of OLED display elements with driver circuits incorporating optical feedback.
Figure 6B:
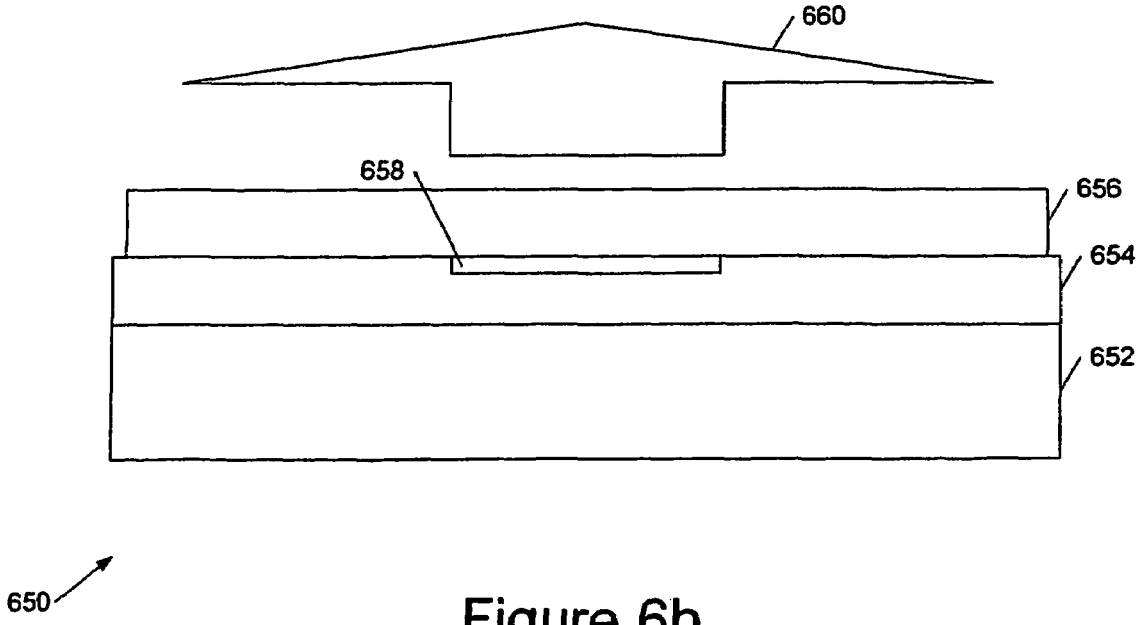

Referring now to FIG. 6, this shows, in outline, two alternative physical structures for OLED pixel driver circuits incorporating optical feedback (the drawings are not to scale). FIG. 6*a* shows a bottom-emitting structure 600 and FIG. 6*b* shows a top-emitter 650.

In FIG. 6*a* an OLED structure 606 is deposited side-by-side with polysilicon driver circuitry 604 on a glass substrate 602. The driver circuitry 604 incorporates a photodiode 608 to one side of the OLED structure 606. Light 610 is emitted through the bottom (anode) of the substrate.

FIG. 6*b* shows a cross section through an alternative structure 650 which emits light 660 from its top (cathode) surface. A glass substrate 652 supports a first layer 654 comprising the driver circuitry and including a photodiode 658. An OLED pixel structure 656 is then deposited over the driver circuitry 654. A passivation or stop layer may be included between layers 654 and 656. Where the driver circuitry is fabricated using (crystalline) silicon rather than polysilicon or amorphous silicon a structure of the type shown in FIG. 6*b* is required and substrate 652 is a silicon substrate.

In the structures of FIGS. 6*a* and 6*b* the pixel driver circuitry may be fabricated by conventional means. The organic LEDs may be fabricated using either ink jet deposition techniques such as those described in EP 880303 to deposit polymer-based materials or evaporative deposition techniques to deposit small molecule materials. Thus, for example, so-called micro-displays with a structure of the type illustrated in FIG. 6*b* may be fabricated by ink jet printing OLED materials onto a conventional silicon substrate on which CMOS pixel driver circuitry has previously been fabricated.

The illustrated embodiments of the driver circuit use PMOS transistors but the circuits may be inverted and NMOS may be employed or, alternatively, a combination of PMOS and NMOS transistors may be used. The transistors may comprise thin film transistors (TFTs) fabricated from amorphous or poly-silicon on a glass or plastic substrate or conventional CMOS circuitry may be used. In other embodiments plastic transistors such as those described in WO 99/54936 may be employed, and the photodiode may comprise a reverse biased OLED to allow the entire circuitry to be fabricated from plastic. Similarly although the circuit has been described with reference to field effect transistors, bipolar transistors may also be used.

The display element driver circuitry has been described with reference to its use for driving organic LEDs but the circuitry may also be employed with other types of electroluminescent display such as inorganic TFEL (Thin Film Electroluminescent) displays, gallium arsenide on silicon displays, porous silicon displays, photoluminescence quenching displays as described in UK patent application no. 0121077.2, and the like. Although the driver circuitry primarily finds applications in active matrix displays it may also be used with other types of display such as segmented displays and hybrid semi-active displays.

The preferred photosensor is a photodiode which may comprise a PN diode in TFT technology or a PIN diode in crystalline silicon. However other photosensitive devices such as photoresistors and photosensitive bipolar transistors and FETs may also be employed, providing they have a characteristic in which a photocurrent is dependent upon their level of illumination.

No doubt many other effective alternatives will occur to the skilled person and it should be understood that the invention is not limited to the described embodiments.

The invention claimed is:

1. Display element driver circuitry for driving an element of an electro-optic display, the circuitry comprising:

a driver to drive the electro-optic display element in accordance with a drive voltage;

a photosensitive device optically coupled to the electro-optic display element to pass a current dependent upon illumination reaching the photosensitive device; and a control circuit having a control line coupled to the driver to control the brightness of the electro-optic display element and having a current sense input coupled to the photosensitive device, a current set line for coupling to a reference current generator and a display element select line to, when active, cause the control circuit to drive the electro-optic display element in accordance with a current set by the reference current generator.

2. Display element driver circuitry as claimed in claim 1, further comprising a storage element coupled to the control line of the control circuit to memorize a drive voltage for said driver, whereby when said element select line is inactive a drive voltage set by the reference current generator is memorized by the storage element.

3. Display element driver circuitry as claimed in claim 2, wherein the storage element comprises a capacitor.

4. Display element driver circuitry as claimed in claim 3, wherein the driver comprises a field effect transistor (FET) and the capacitor comprises a gate capacitance of said FET.

5. Display element driver circuitry as claimed in claim 1, wherein said control circuit comprises two FET switches, each FET switch being responsive to a signal on said element select line to couple said current set line to said control line and to said current sense input when said element select line is active.

6. Display element driver circuitry as claimed in claim 1, further comprising a common-gate transistor coupled between said photosensitive device and said current sense input.

7. Display element driver circuitry as claimed in claim 6, further comprising a bias set transistor matched to said common-gate transistor and having a gate coupled to a gate of said common-gate transistor.

8. Display element driver circuitry as claimed in claim 7, further comprising bias cycle means to pass a current determined by the current set line through said bias set transistor.

9. Display element driver circuitry as claimed in claim 8, wherein said bias cycle means comprises a compensate line and a bias cycle FET switch responsive to a signal on said compensate line to pass current for said current set line through said bias set transistor when said compensate line is active.

10. Display element driver circuitry as claimed in claim 8, wherein said bias cycle means further comprises bias hold means to hold a bias setting for said common-gate or common-base transistor.

11. Display element driver circuitry as claimed in claim 10, wherein said bias hold means comprises a bias hold capacitor coupled to said gate or base of said common-gate or common-base transistor, and a bias hold FET switch responsive to a signal on said compensate line to substantially isolate said bias hold capacitor and said gate or base of said common-gate or common-base transistor when said compensate line is inactive.

12. Display element driver circuitry as claimed in claim 1, further comprising a common-base transistor coupled between said photosensitive device and current sense input.

13. Display element driver circuitry as claimed in claim 12, further comprising a bias set transistor matched to said common-base transistor and having a base coupled to a base of said common-base transistor.

14. Display element driver circuitry as claimed in claim 9, further comprising bias cycle means to pass a current determined by the current set line through said bias set transistor.

15. An active matrix display comprising a plurality of electro-optic display elements, each display element having associated display element driver circuitry as claimed in claim 1.

16. An active matrix display as claimed in claim 15 having row and column display element drive lines, said row drive lines being coupled to one of the element select lines and current set lines of the display element driver circuitry of the display elements, said column drive lines being coupled to the other of the element select lines and current set lines of the display element driver circuitry of the display elements.

17. An active matrix display as claimed in claim 15, wherein said electro-optic display elements comprises an organic light emitting diode.

18. Display element driver circuitry as claimed in claim 1, wherein a said electro-optic display element comprises an organic light emitting diode.

19. A method of controlling the brightness of electro-optic display elements in an active matrix display, the method comprising:

providing a photosensitive device for each element, the photosensitive device passing a photocurrent dependent upon the illumination of the device;

sensing the brightness of each element by sensing the photocurrent passed by the photosensitive device for the element; and controlling the brightness of each element so that the sensed photocurrent is determined by a reference current.

20. A method as claimed in claim 19, wherein said active matrix display includes a driver for each display element, each driver having a storage capacitor to store a display element drive voltage, and wherein said controlling further comprises:

compensating for a difference between said reference current and said photocurrent by charging or discharging said storage capacitor.

21. A method as claimed in claim 19, further comprising:

operating said photosensitive device under reduced bias conditions by dropping at least a portion of a bias voltage for said device across a transistor.

22. A method as claimed in claim 21, further comprising a bias cycle prior to said sensing and controlling, the bias cycle comprising:

setting a bias for said photosensitive device using said reference current.

* * * * *